United States Patent [19]

Yang

[11] Patent Number: 4,570,515

[45] Date of Patent: Feb. 18, 1986

[54] MOVABLE WRENCH EQUIPPED WITH MOVABLE CLAW WHICH IS DRIVEN AND ROTATED BY ADJUSTING ROD

[76] Inventor: Tai-Her Yang, 5-1 Tay Pyng St., Shi Hwu Jenn, Jang Huah Shiann, Taiwan

[21] Appl. No.: 551,691

[22] Filed: Nov. 14, 1983

[51] Int. Cl.[4] ..... B25B 13/16

[52] U.S. Cl. ..... 81/166

[58] Field of Search ..... 81/166, 167, 168, 169, 81/170, 171, 172

[56] References Cited

U.S. PATENT DOCUMENTS

| | | | |
|---|---|---|---|
| 784,243 | 3/1905 | Whaley | 81/165 |
| 1,354,782 | 10/1920 | Schlote | 81/165 |
| 1,886,907 | 11/1932 | Rugger | 81/165 |

*Primary Examiner*—James L. Jones, Jr.

*Attorney, Agent, or Firm*—Cushman, Darby & Cushman

[57] ABSTRACT

The present invention relates to a movable wrench equipped with movable claw which is driven and rotated by adjusting rod, wherein front and rear ends of rotary shaft respectively couples with I type Fan-shaped gear and adjusting rod by two pins, and concave ring of I type fan-shaped gear is propped by screw, and when adjusting rod is rotating, rotation of adjusting rod moves through rotary shaft and I type fan-shaped gear to fan-shaped gear at another end of adjusting rod and drives fan-shaped gear to slid the movable claw forward and backward. Further design of the present invention is to dig a longitudinal groove for sliding a driving pin at the bottom end of rotary shaft, and in the inner hole of adjusting rod, there designed inner thread for screwing with external thread of handle, owing to the above-mentioned design adjusting rod can adjust movable claw, to increase or decrease length of handle, and increase arm of force to save labor and let movable claw not slid when workpiece is wrenched.

1 Claim, 6 Drawing Figures

MOVABLE WRENCH EQUIPPED WITH MOVABLE CLAW WHICH IS DRIVEN AND ROTATED BY ADJUSTING ROD

FIELD OF THE INVENTION

The present invention relates to an adjustable wrench having a movable claw which is driven and rotated by an adjusting rod.

BACKGROUND OF THE INVENTION

The manufacturing procedure of the conventional movable wrench is complicated and can not be simplified. It therefore can not save material. Moreover, when a snail rod has been provided with an adjustable movable claw there existed a gap between the screw rod of the movable wrench and the movable claw. The movable claw could not clamp firmly on a work piece. As a result, an undesired sliding phenomenon was evidenced.

With the foregoing in mind, applicant's objects included developing a movable wrench equipped with a movable claw which is driven and rotated by an adjusting rod in order to provide a movable claw equipped in the movable wrench and which does not need to be extracted out to place in a reverse adjustment.

SUMMARY AND OBJECTS OF THE PRESENT INVENTION

Broadly speaking, the instant invention provides a wrench structure having a stationary handle portion and a rotatable adjusting rod portion, wherein the two elements cooperate through a particular gearing arrangement to adjust a movable claw (jaw).

The present invention relates to a movable wrench equipped with a movable claw which is driven and rotated by adjusting rod wherein one embodiment front and rear ends of a rotary shaft respectively couple with an I type fan-shaped gear and adjusting rod via two pins. A concave ring in I type fan-shaped gear configured to receive a screw. When the adjusting rod is rotated, the rotary shaft and the I type fan-shaped gear turn and the latter gear meshes with another fan-shaped gear at one end of the screw gear. The screw gear drives the movable claw forward and backward.

In spite of the defects and disadvantages of the disclosed prior art the instant present invention provides a movable wrench equipped with a movable claw which is driven and rotated by an adjusting rod. The present invention permits a simplified manufacturing procedure to be used with lower costs while saving material. Advantageously, the present invention provides a movable claw which firmly clamps the workpiece without sliding.

Further advantageous design features of the present invention include a specially designed rotary shaft having a longitudinal groove therein for receiving a sliding driving pin in combination with an extenable handle and adjustable rod arrangement which permits increasing or decreasing the effective length of handle. This can increase the leverage available to be applied to a work piece clamped in the wrench jaws. This saves labor while the movable claw does slide when workpiece is wrenched.

DESCRIPTION OF THE PREFERRED EMBODIMENTS

Figure 3:
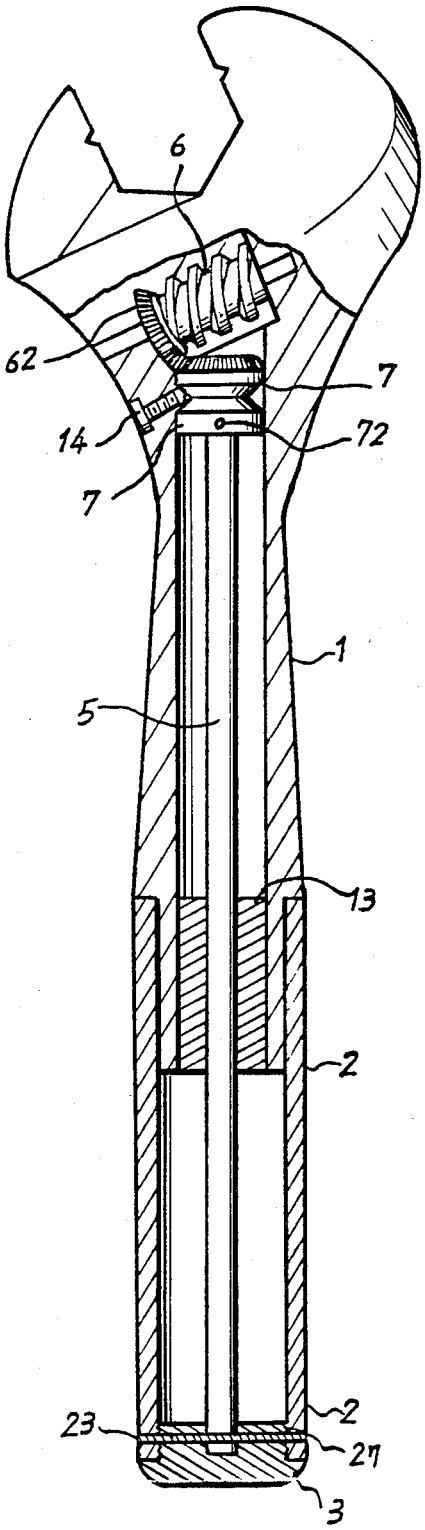
FIG. 3 is an exploded view of the first embodiment of the present invention.

Reference is now made to the figures in the drawings to further illustrate the present invention.

Figure 1:
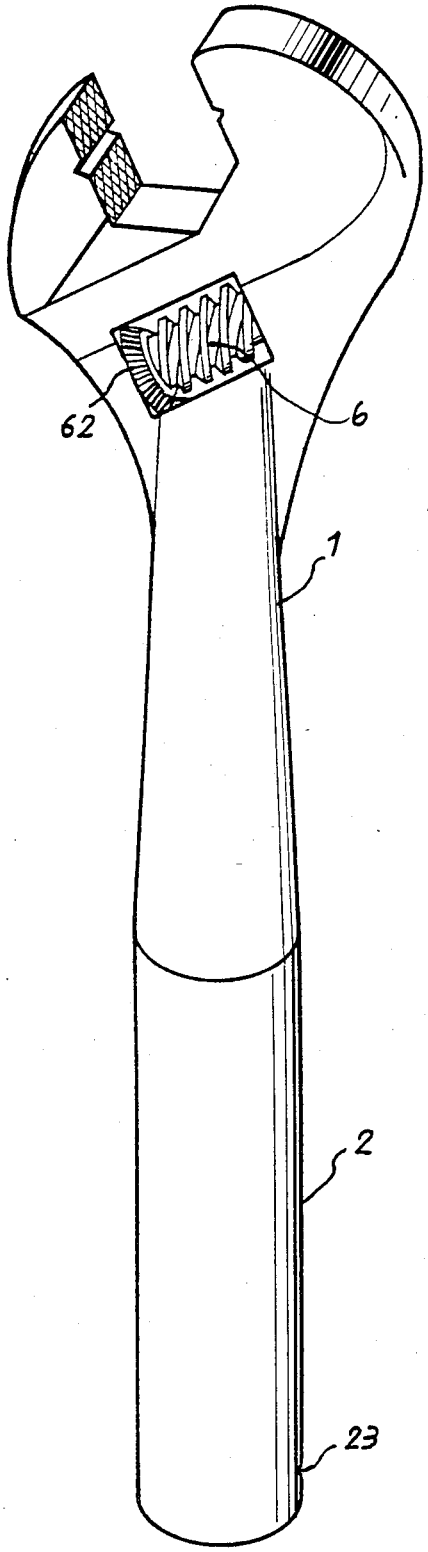
FIG. 1 is a perspective view of the first embodiment of the present invention.
Figure 2:
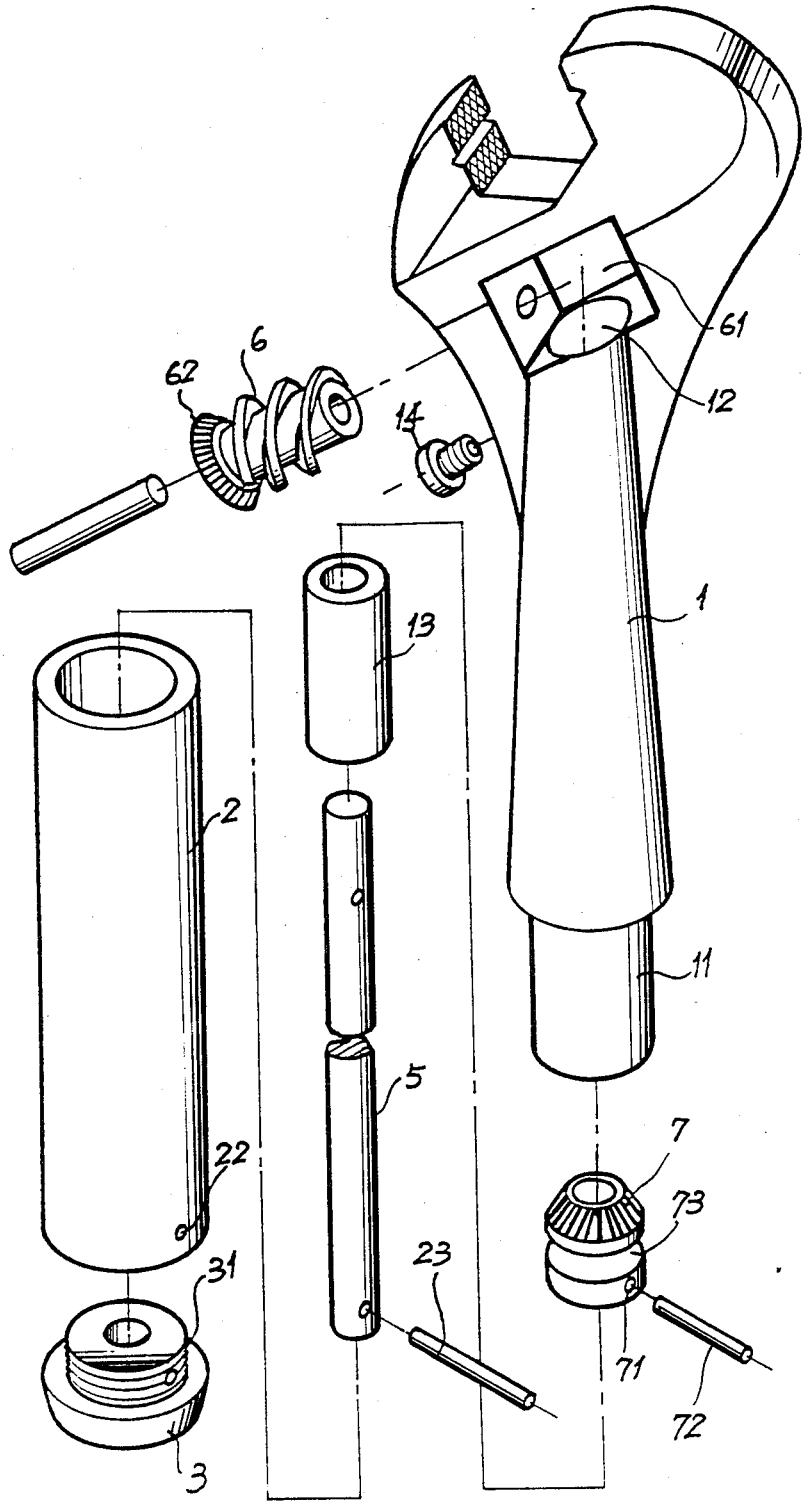
FIG. 2 is a perspective segmental view of the first embodimment of the present invention.

The first embodiment is shown in FIGS. 1, 2 and 3.

The handle 1 of movable wrench is designed as a hollow round or conically shaped rod and is formed integral with a wrench head. The wrench head has a track or slideway for a claw which will hereinafter be described. Handle 1 has a mandrel, and the top end of inner hole 12 opens into adjusting mouth 61.

An I type fan-shaped gear 7 is positioned at the bottom side of mouth 61 and inner hole 12 of handle 1. The fan-shaped gear 7, as designd, has an eyelet 71 at its botom end. Eyelet 71 is configured to receive upper joint pin 72. Joint pin 72 penetrates the eyelet 71 and couples the rotary shift 5 to the fan-shaped gear 7. Accordingly, when rotary shift 5 is driven than I type fan-shaped gear 7 will also rotate.

The top end of handle 1 has two sides. At one side a set screw 14 is placed. Set screw 14 rides within the concave ring 73 of fan shaped gear in order to maintain adjusting rod in alignment and to prevent adjusting rod 2 from separating from the handle 1.

Screw rod 6 is received in the mouth 61 of handle 1. The screw rod is rotably mounted on an axle (rod) 65. Screw rod 6 includes a fan-shaped gear 62. When assembled, fan-shaped gear 62 meshes with fan-shaped gear 7.

Shaft 5 extends from the gear arrangement at the head of handle 1 downwardly to the bottom of adjusting rod 2.

The handle 1 has an external grade 11. As shown in FIG. 2, the external (small) grade 11 is, in reality, an extension to handle 1 and has a smaller cross-sectional outer-wall diameter than handle 1 at point 90. Also, as shown in FIG. 2 and FIG. 3, the grade 11 has a constant cross-section-outer-wall diameter. Grade 11 has a central core which is hollow.

An adjusting rod 2 and engages with grade 11. Adjusting rod 2 is essentially hollow. The inner surface of the top end of adjusting rod 2 which engages grade 11 may be smooth as shown in FIGS. 2 and 3. In this embodiment, the adjusting rod 2 slips over grade 11 and can be rotated agout grade 11. An inner thread section 27 is provided about a portion of the inner wall at the bottom of the adjusting rod 2. The inner thread section 27 matches the external thread section 31 of screw nut 3. Thus, screw nut 3 screws into the bottom of adjusting rod 2. An eyelet 22 is placed at the bottom end of adjusting rod 2. Eyelet 22 is used in conjunction with lower joint pin 23 to couple screw nut 3 to the bottom portion of adjusting rod 2 and rotary shaft 5. With this arrangement, when the wrench of the invention is assembled, adjusting rod 2 may be rotated to drive rotary shaft 5 which in turn engages gears to open or close the claw 80. The claw 80, of course, works within a recessed track, (not shown) in the head portion of handle 1 so that the geared surface on the bottom of claw 80 fronts the upper side of the mouth and is in inoperative meshing engagement with the screw gear 6 (see FIG 3).

A setting ring 13 is placed at the bottom end of inner hole 12 of handle 1. A setting ring 13 is used to support the rotation and to position the rotary shaft 5. Thus, rotary shaft 5 is considered journaled through setting ring 13.

Figure 6:
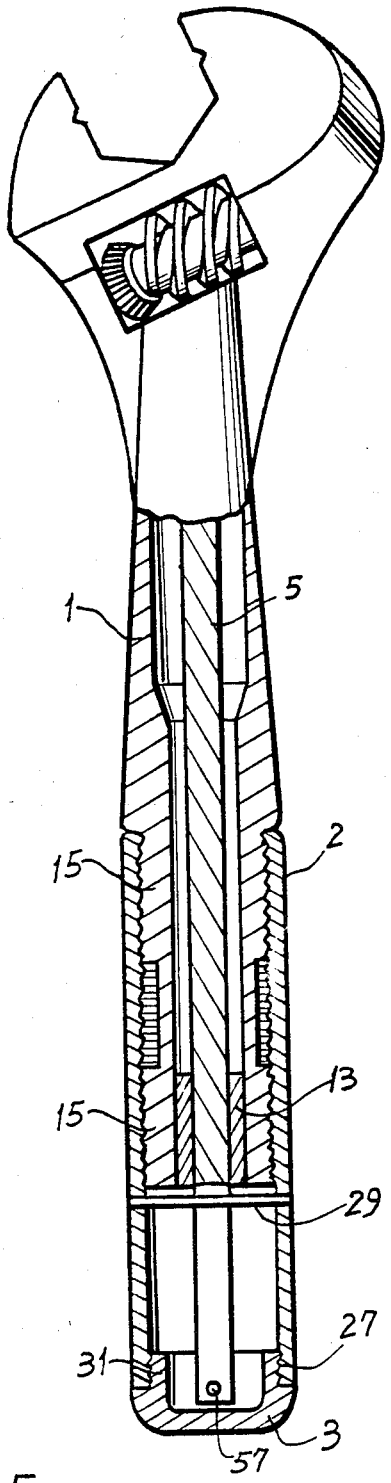
FIG. 6 is an exploded view of the second embodiment of the present invention.
Figure 4:
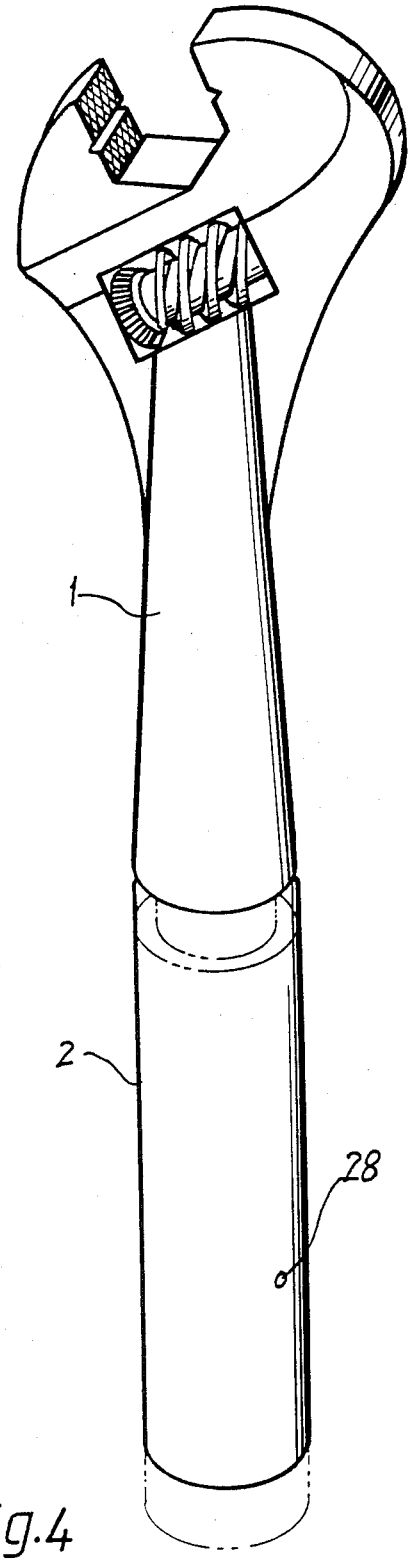
FIG. 4 is a perspective view of the second embodiment of the present invention.
Figure 5:
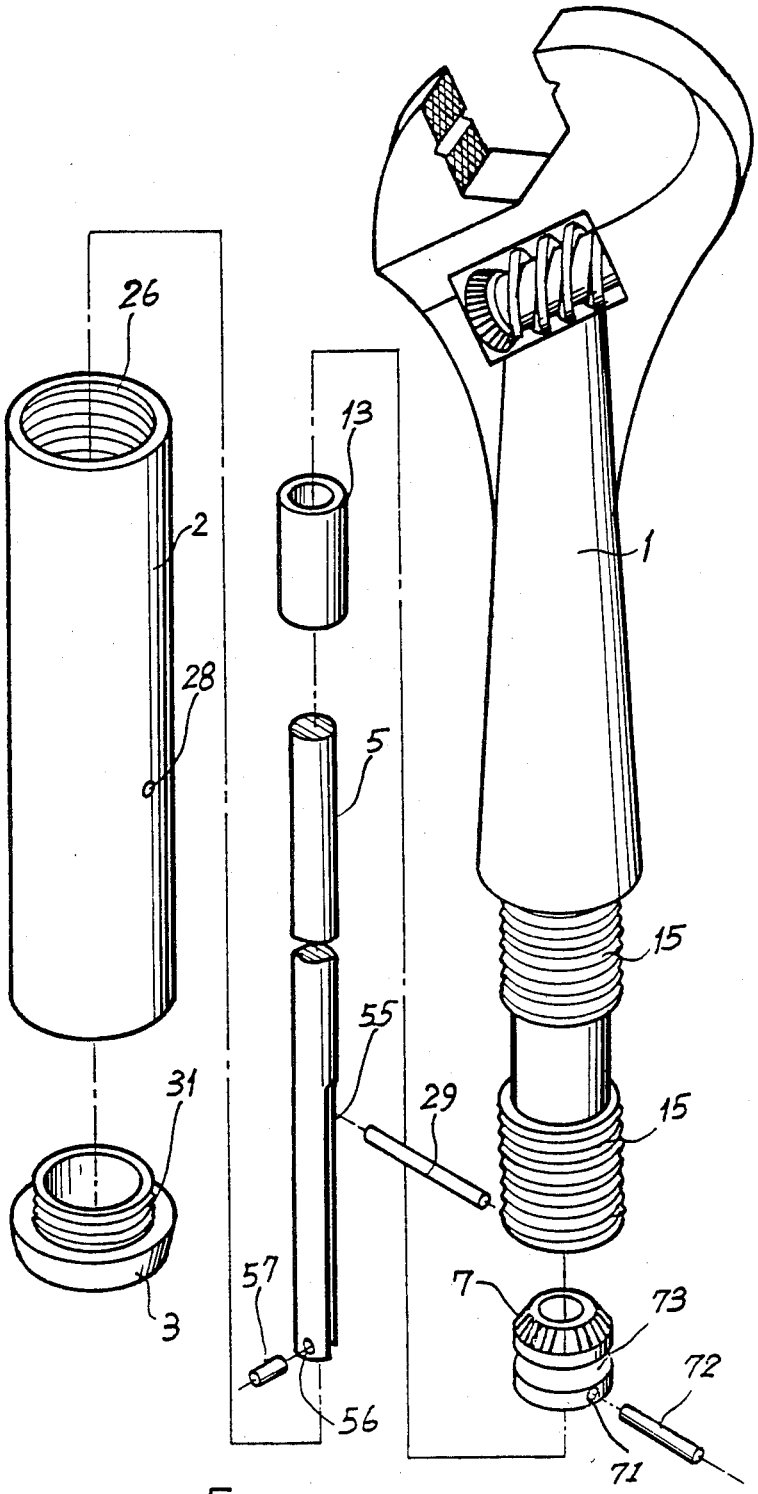
FIG. 5 is a perspective segmental view of the second embodiment of the present invention.

The second embodiment of the present invention is shown in FIGS. 4, 5 and 6. The adjusting rod 2 is hollow. Adjusting rod 2 has a top end 40. Inner screw threads are provided about the inner wall of adjusting rod 2 for a pre-determined distance from the top end 40 towards the bottom end 41. Inner threads 26 mesh with external thread 15 on handle 1. The bottom end 41 of adjusting rod 2 is provided with inner threads 27. Inner threads 27 mesh with the external threads 31 of bottom end screw nut 3. Thus, screw nut 3 screws into the bottom end of adjusting rod 2. Near the bottom end of central inner thread 26, there is a correspondent hole 28. Hole 28 is configured to receive driving pin 29. A groove 55 is provided in the lower portion of rotary shaft 5. Driving pin 29 penetrates through hole 28 and through groove 55 in order to drive the rotary shaft 5 by driving pin 29. An eyelet is provided at the bottom end of rotary shaft 5. This eyelet 56 is configured to receive a distance-setting pin 57. Distance-setting pin 57 penetrates through eyelet 56. This distance-setting pin 57 is to limit the distance of rotating adjusting rod backward in order to prevent adjusting rod 2 separating from handle 1.

The upper end of handle tapers in a conic rod shape. At the bottom margin, there is a reversed angle which corresponds to the external reversed angle provided at the top margin of adjusting rod 2, the lower end is provided with a two-sectional external thread 15. A setting ring 13 supporting the rotation and positioning rotary shaft is disposed at the bottom end of the inner hole of handle 1. The structure above handle 1 is the same as the first embodiment.

The operation of the second embodiment is now described. When the wrench user rotates adjusting rod 2, the central inner thread 26 of adjusting rod 2 moves correspondently to the two-sectional external thread 15 of handle 1, and gradually rotates backward adjusting rod 2 drives the driving pin 29 to rotate toward to the bottom of groove 55 of rotary shaft 5, when driving pin 29 drives and moves to distance-setting pin 57, adjusting rod 2 can not rotate backward because driving pin 29 can not continuously drive and move down, the distance of rotating backward can be indicated by the upper sectional thread to lower end of handle 1 as shown in FIG. 4 in dotted line.

We claim:

1. A wrench having an adjustable claw comprising:

a hollow handle, said handle having an open mouth; a first fan-shaped gear mounted in said handle and fronting said mouth;

a gear axle;

a second fan-shaped gear in meshing engagement with said first fan-shaped gear;

said second fan-shaped gear axially mounted for rotation on said gear axle; a screw gear mounted on said gear axle;

a movable claw having a bottom portion thereof mounted in a track in said handle, said bottom portion having a geared surface, said gear surface in meshing engagement with a said screw gear, said bottom portion fronting the top portion of said mouth;

a hollow adjusting rod rotatingly coupled to said handle;

a rotary shaft extending from the base of said adjusting rod to the base of said first fan-shaped gear;

threaded means rotably setting said first fan-shaped gear in operative position in the said handle, said first fan-shaped gear having groove means for cooperating with and receiving said threaded setting means.

* * * * *